US007458574B2

(12) United States Patent
Wilcox et al.

(10) Patent No.: US 7,458,574 B2
(45) Date of Patent: Dec. 2, 2008

(54) LEVELING DEVICE FOR REMOVING VALLEYS IN STACKED OBJECTS

(75) Inventors: Raymond D. Wilcox, Fairport, NY (US); Stephen A. Demchock, Rochester, NY (US); Richard A. Van Dongen, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 407 days.

(21) Appl. No.: 11/275,407

(22) Filed: Dec. 29, 2005

(65) Prior Publication Data

US 2007/0257419 A1 Nov. 8, 2007

(51) Int. Cl.
*B65H 1/08* (2006.01)

(52) U.S. Cl. ..... 271/148

(58) Field of Classification Search ..... 271/148
See application file for complete search history.

(56) References Cited

U.S. PATENT DOCUMENTS

| | | | | |
|---|---|---|---|---|
| 2,886,314 | A | 5/1959 | Phelan | |
| 3,239,219 | A * | 3/1966 | Reeves | 271/148 |
| 3,659,727 | A * | 5/1972 | Pearsall | 414/788.2 |
| 4,188,026 | A * | 2/1980 | Nagai | 271/148 |
| 4,303,152 | A * | 12/1981 | Widmaier | 198/468.7 |
| 4,787,325 | A * | 11/1988 | Black et al. | 112/470.36 |
| 4,942,435 | A | 7/1990 | Kneisel et al. | |
| 5,044,622 | A * | 9/1991 | Cattin | 271/121 |
| 5,302,080 | A * | 4/1994 | Smith et al. | 414/788.2 |
| 5,332,210 | A * | 7/1994 | Silverberg et al. | 271/220 |
| 5,364,087 | A | 11/1994 | Schieck et al. | |
| 5,486,911 | A * | 1/1996 | Rubscha et al. | 399/364 |
| 5,737,987 | A * | 4/1998 | Olson et al. | 83/89 |
| 6,142,689 | A * | 11/2000 | Margiotta | 400/624 |
| 6,213,460 | B1 * | 4/2001 | Cahill et al. | 271/161 |
| 6,260,842 | B1 * | 7/2001 | Nelson et al. | 271/145 |
| 6,283,469 | B1 * | 9/2001 | Weber | 271/148 |
| 6,629,693 | B2 * | 10/2003 | Siow et al. | 271/171 |
| 6,648,323 | B2 * | 11/2003 | Hsieh | 271/126 |
| 2006/0284366 | A1 * | 12/2006 | Van Dongen et al. | 271/148 |
| 2007/0120318 | A1 * | 5/2007 | Moore | 271/148 |

* cited by examiner

*Primary Examiner*—Patrick H Mackey
*Assistant Examiner*—Howard Sanders
(74) *Attorney, Agent, or Firm*—Oliff & Berridge, PLC

(57) ABSTRACT

A leveling device assists in support of stackable objects having a non-uniform thickness, such as DocuCards, in a stackable tray. The stackable tray includes a pivoting tray that can be pivoted from a full sheet stack position to an empty sheet stack position. A valley removal mechanism is provided on the pivoting tray to variably support an intermediate portion of the bottom of the stack to compensate for and remove a valley created intermediate ends of the stack due to an aggregate effect of stack media of non-uniform thickness. The valley removal mechanism preferably includes a support surface that contacts a bottom of the stack, a ramp defining a ramp profile, and a ramp follower that guides the support surface to a variable orientation that compensates for the valley as the stack height changes.

18 Claims, 9 Drawing Sheets

LEVELING DEVICE FOR REMOVING VALLEYS IN STACKED OBJECTS

BACKGROUND

The disclosure relates to a leveling device for a stacking tray. The leveling device compensates for end-to-end thickness variations in certain stacked objects, such as specialty recording media, and reduces any valley in the stack.

SUMMARY

In both home office and in commercial office equipment including copiers, printers or xerographic machines, stackable media, such as paper sheets, are fed using a sheet feeding mechanism from an input storage tray onto an output tray. Frequently, the paper sheets are stored on an elevator type of sheet feeding tray that adjusts to accommodate a variable number of sheets.

FIG. 1 shows a conventional office device, such as a xerographic machine 100, that may include a feed tray 102, a feeder 110 and a print engine 108. The feed tray includes a tray lift 106 that may be guided by a lift guide 114. Recording media 104, such as flat sheets of paper, may be stacked above the tray lift 106 and moved in a substantially linear movement direction 116.

Tray lift 106 lifts the stack of recording media 104 upwards so that a feeder 110, such as belt assembly 112, may separate a top recording medium from the stack and feed the top recording medium into print engine 108 for processing.

Although interface requirements between the top recording medium and belt assembly 112 may vary depending on different types of feeding mechanisms, it is usually a requirement that the top surface of the top recording medium is substantially parallel to (or flat relative to) a bottom surface of belt assembly 112. This provides sufficient contact between belt assembly 112 and the top surface of the top recording medium to achieve proper feeding. In addition, a leading edge of the top recording medium usually must be aligned with an input port of the print engine 108 to achieve successful feeds. This is readily achieved when feeding flat recording media. However, when recording media 104 is thicker at one end than at other portions, the top surface of the top recording medium of a stack of such recording media may have one end that is substantially closer to belt assembly 112 than its remaining portion due to the accumulated thicknesses of the complete stack of recording media. This may result in jams, misfeeds or other problems.

Thus, feed tray 102 shown in FIG. 1 is efficient for recording media 104 having substantially uniform thickness and can feed a rather large stack of such media. However, if the thickness distribution of the recording media is not substantially uniform, then stacking and feeding difficulties may arise.

Frequently, specialized forms or media having such a non-uniform thickness are required for certain applications. Such specialized forms may include a paper sheet with labels or ID cards affixed thereto. One specific example of this includes DocuCards, available from Xerox Corporation. These are xerographically printable membership, identification or other cards provided on a sheet of paper. Each sheet has one or more of such ID cards mounted thereon. The cards, typically sized 3.375"×2.125", are attached to one side of the sheet. An example of a DocuCard 118 is shown in FIGS. 2-3 and consists of a base substrate 119, such as a sheet of paper, having one or more ID cards 120 affixed thereto, typically affixed near one end, such as end 140.

Because of the addition of the card(s), such sheet media have a non-uniform thickness. Thus, when stacked as shown in FIG. 4, an end 140 with the cards 120 ends up higher, because it is thicker than the opposite side 130 that just has the base substrate 119. When several such DocuCards 118 are stacked, the uneven stack height is compounded, as shown by height difference Δ. Therefore, to reduce feeding problems due to uneven stack height, this type of media was often fed in only very small quantities (100 sheets or less) on conventional flat stacking trays.

One attempt to solve this problem was the Tiltatron, a specialized modular tray insert made by Xerox that was insertable into a conventional printing machine stacking tray. The Tiltatron has a pivoting leveling tray that pivotally supports the thicker end of the stack. An example of this can be found in U.S. Pat. No. 5,364,087 to Schieck et al., assigned to Xerox Corporation.

A Tiltatron-type pivoting device is shown in FIG. 5 and includes a pivoting tray 200 mounted in a conventional flat stacking tray assembly 102 having a lifting tray 106. When loaded with sheets of DocuCards, tray 200 is pivoted downward as shown. When the lifting tray rises, and the remaining sheet count decreases, the pivoting tray 200 tilts upward with a shallower angle. This results in sheet ends 130, 140 that are substantially level throughout the travel. Such Tiltatron-type devices have been used with success using relatively small stacks of DocuCards, typically 200 sheets or less. This enabled an increase in stack capacity for non-uniform thickness media stacks over a conventional flat elevator tray. At higher capacities, however, such as in excess of 200 sheets, a noticeable valley 150 may form in the stack between the ends 130, 140. For example, when about 600 sheets are loaded into the tray of FIG. 5, a valley of several inches in depth can occur. Although not necessarily a problem with many types of sheet feeder mechanisms, valley 150 may cause feeding problems with certain sheet feeder mechanisms. For example, sheet feeder mechanisms such as rollers acting on leading sheet edges may be unaffected by the valley. However, certain feeders, such as vacuum feeder assemblies, endless belt feeder assemblies or airjet feeder assemblies, rely on contact or interaction with a substantial portion of the top sheet surface. A large valley in a top sheet may interfere with proper feeding operation, resulting in inconsistent or improper sheet acquisition by the feeder assembly. This is due to the valley causing an arcuate, non-parallel surface profile.

In accordance with various aspects, a leveling device within a stack tray is provided to support such non-uniform media that not only levels the ends of the media stack, but also reduces and preferably minimizes the valley formed near the center of the paper stack to improve sheet acquisition and provide a flatter top media surface.

Using such a leveling tray, stackable media having non-uniform thicknesses may be stacked in larger quantities, such as about 600 sheets or more, while maintaining a desirable position for proper feeding or stacking.

In accordance with various aspects, a valley removal mechanism provides a variable height support surface that lifts intermediate portions of the stack to offset the valley in proportion to the height of the stack.

In accordance with various aspects, a leveling device for a stacking tray compensates for end-to-end thickness variations in a stack of non-uniform thickness media and reduces a valley in the stack, includes a pivoting stack tray and a valley removal mechanism. The pivoting stack tray receives a stack of non-uniform thickness media thereon, one end of the tray receiving a thicker end of the stack being pivoted relative to an opposite end thereof between full tray and empty tray positions to provide level top ends of the stack. The valley removal mechanism is mounted to the pivoting tray. The valley removal mechanism includes: a media support surface positioned above the pivoting tray intermediate ends of the pivoting tray and below the stack, the media support surface supporting at least a portion of an intermediate section of the stack and being pivotally movable relative to the pivoting stack tray; a ramp surface having a predefined profile; and at least one lever arm operably connected between the media support surface and at least one ramp follower to move the media support surface relative to the pivoting tray in accordance with the ramp surface profile and in proportion to the height of the stack to offset a valley formed intermediate ends of the stack and provide a top media in the stack with a substantially flat top surface profile.

In accordance with various aspects, a feeder assembly for feeding a stack of non-uniform thickness media is provided. The feeder assembly includes a pivoting stack tray, a valley removal mechanism, and a feeder. The pivoting stack tray receives a stack of non-uniform thickness media thereon, one end of the tray receiving a thicker end of the stack being pivoted relative to an opposite end thereof between full tray and empty tray positions to provide level top ends of the stack. The valley removal mechanism is mounted to the pivoting tray and includes: a media support surface positioned above the pivoting tray intermediate ends of the pivoting tray and below the stack, the media support surface supporting at least a portion of an intermediate section of the stack and being pivotally movable relative to the pivoting stack tray; a ramp surface having a predefined profile; and at least one lever arm operably connected between the media support surface and at least one ramp follower to move the media support surface relative to the pivoting tray in accordance with the ramp surface profile and in proportion to the height of the stack to offset a valley formed intermediate ends of the stack and provide a top media in the stack with a substantially flat top surface profile. The feeder is positioned directly above the top media in the stack, the feeder having a media contact surface. The combination of the pivoting stack tray and valley removal mechanism position a top media in the stack substantially parallel with the media contact surface of the feeder at all travel positions of the pivoting stack tray between the full tray and empty tray positions.

BRIEF DESCRIPTION OF THE DRAWINGS

Various disclosed exemplary embodiments of the systems and methods will be described in detail, with reference to the following figures, wherein.

DETAILED DESCRIPTION OF EMBODIMENTS

As discussed above, many types of machines process objects that are stacked in one or more stack trays, and each object of the stack may be input into the processing machine from a first stack tray, processed and output to another stack tray. For ease of discussion, an office device 250, such as a xerographic copier, printer, or digital press, is used as an example to illustrate various features related to a feeder stack tray having a leveling device that removes a valley from the stack.

Figure 7:
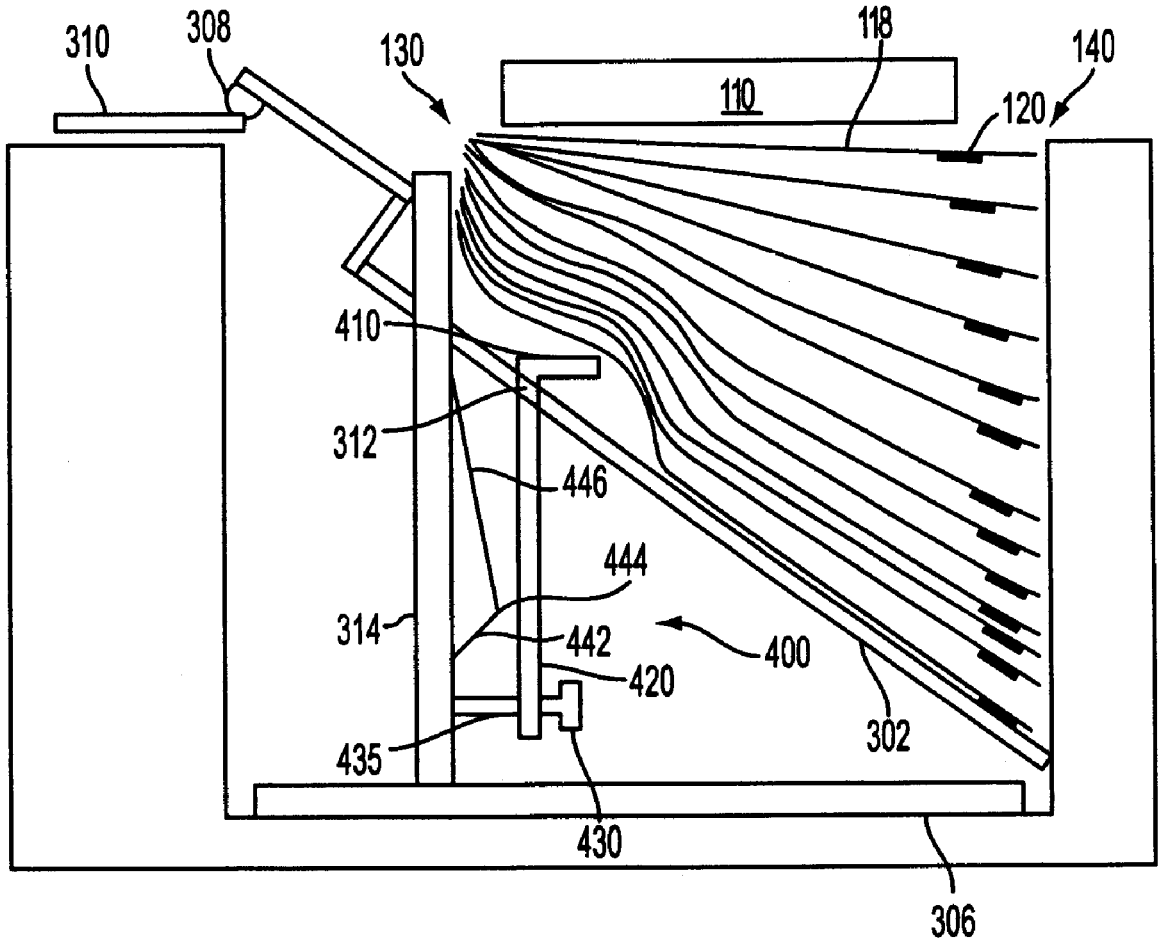
FIG. 7 shows an exemplary stacker tray with a valley removal mechanism in a full tray position having a large stack of DocuCards.

An exemplary stack tray 300 is shown in FIG. 7 useful as a feed stack tray for office machine 250. The office machine 250 is preferably a digital production press, but could be any conventional copier or printer as known in the art that can process non-uniform thickness media. In FIG. 7, feed stack tray 300 is preferably positioned below a feeder 110, such as a vacuum feeder assembly, endless belt feeder assembly, or air jet feeder assembly, and adjacent to or within office machine 250. Feed stack tray 300 includes a valley removal mechanism 400 for leveling a stack of non-uniform thickness media.

Figure 8:
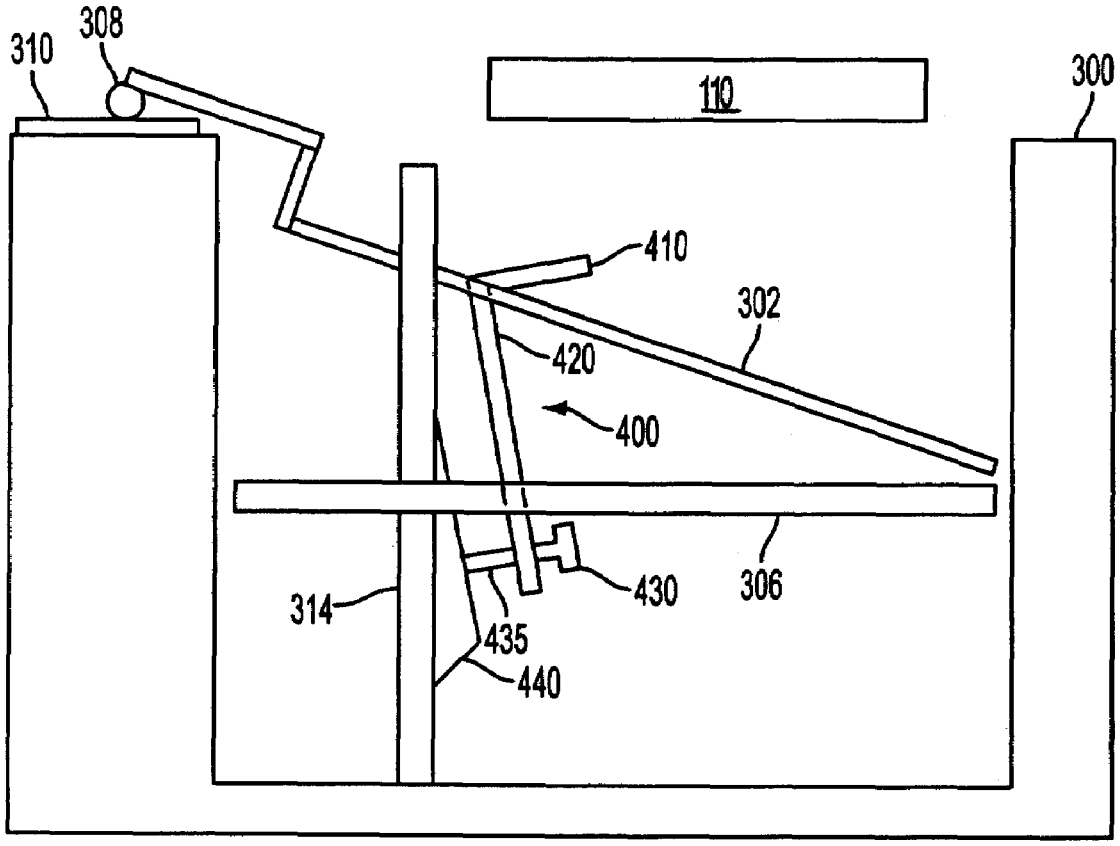
FIG. 8 shows the stacker tray of FIG. 7 at mid-level of travel.
Figure 9:
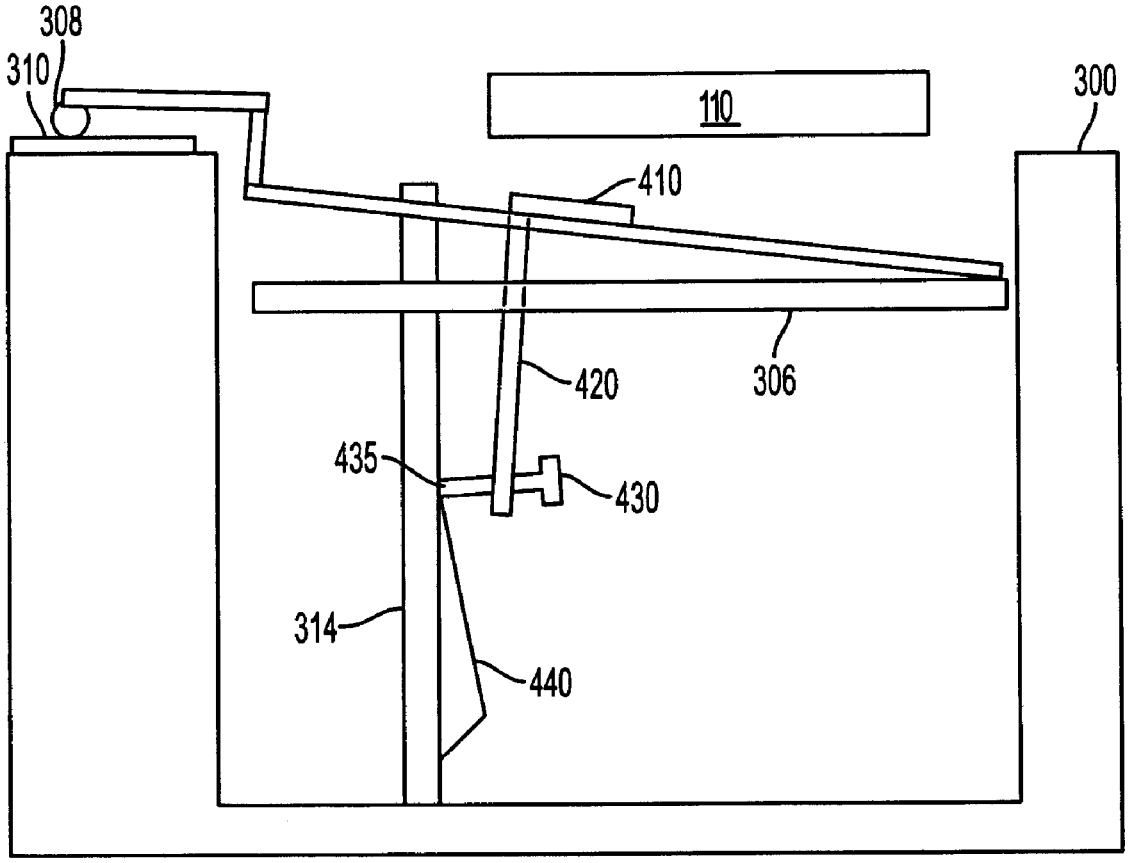
FIG. 9 shows the stacker tray of FIG. 7 at a full raised position (at or near empty stack)
Figure 10:
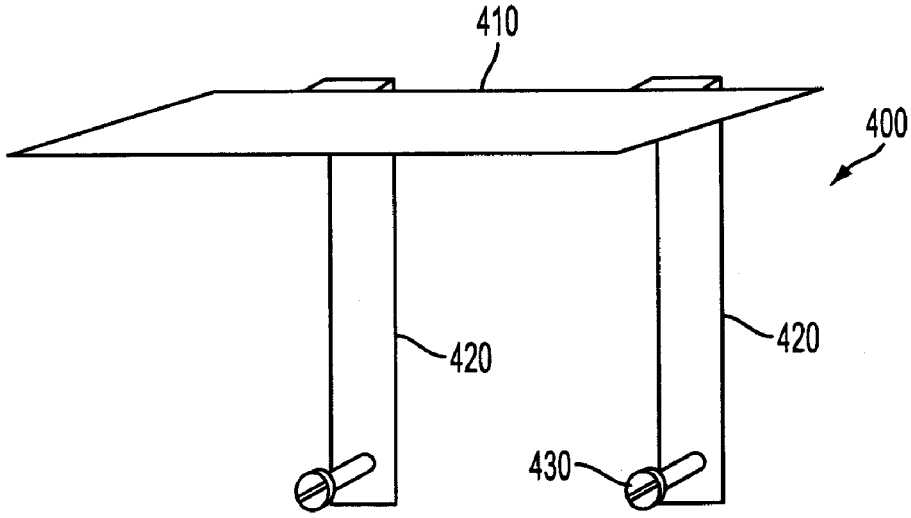
FIG. 10 shows a perspective view of an exemplary valley removal mechanism.
Figure 11:
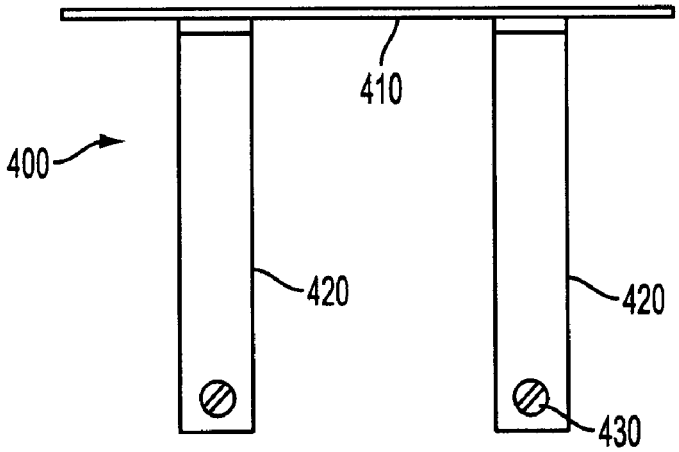
FIG. 11 shows a front view of the valley removal mechanism of FIG. 10.
Figure 12:
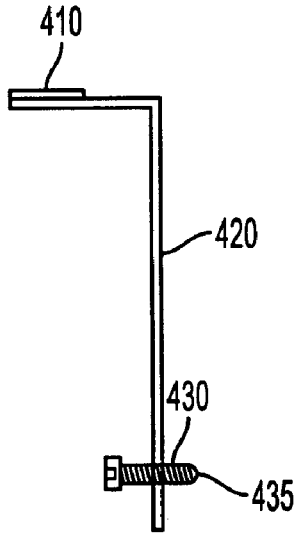
FIG. 12 shows a side view of the valley removal mechanism of FIG. 10.
Figure 13:
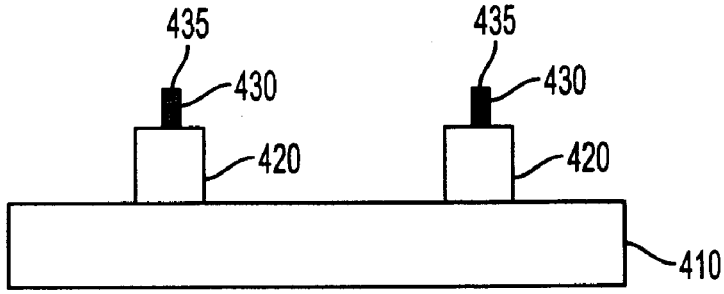
FIG. 13 shows a top view of the valley removal mechanism of FIG. 10.

Additional details of an exemplary stack tray 300 and valley removal mechanism 400 will be described with respect to FIGS. 7-13. FIG. 7 shows stack tray 300 in a fully loaded position (with only a few non-uniform thickness media, such as DocuCards 118, shown for purpose of illustration). This position is capable of supporting over 200 sheets of media, preferably up to about 600 sheets. FIG. 8 shows stack tray 300 in an intermediate partially loaded position (with media omitted for purpose of illustration). FIG. 9 shows stack tray 300 in a near empty position (with media omitted for purpose of illustration). Each result in a stack of non-uniform thickness media 118 being positioned throughout travel so that a top media sheet has a substantially flat profile, with the valley between opposite ends of the sheet ends minimized or dramatically reduced as shown in FIG. 7. When stack tray 300 is used as a feed tray, the orientation results in the top sheet being substantially parallel to the sheet feeder 110.

Stack tray 300 includes a pivoting tray 302 that may be a permanent fixture of the stack tray or may be a removable insert used only for support of non-uniform thickness media. In the latter case, pivoting tray may be non-powered and acted upon by a conventional horizontal elevator tray lift 306 that may be guided by a lift guide 314, which may also serve as a paper guide.

A stack of non-uniform media, such as DocuCards of up to about 600 sheets or more, may be stacked on top of pivoting tray 302, with the thick end 140 of the stack oriented towards the far lower end of the tray. Rising of tray lift 306 causes a lifting of the far end of pivoting tray 302. As the pivoting tray 302 is urged upwards between full and empty tray positions, the ends 130, 140 of the media stack are moved upward so that top ends of the stack remain level. However, because of the large capacity, a valley forms intermediate media ends 130, 140. This valley is compensated for by a valley removal mechanism 400 discussed below.

Valley removal mechanism 400 is provided within feed stacking tray 300 and assists in variably supporting a central part of the sheet stack to remove the valley. Valley removal mechanism 400 includes a sheet media support surface 410, at least one lever arm 420, a ramp member 440, a ramp follower 435, and an optional adjustment mechanism 430. As better shown in FIGS. 10-14, support surface 410 can take the form of a flat cross bar that extends transverse to the sheets 118 from a leading edge to a trail edge running substantially parallel to the valley formed by the stack of sheets.

Cross bar 410 functions to independently raise intermediate portions of the stack in proportion to the valley to offset, remove or substantially limit the valley. That is, the valley 150 in FIG. 5 can be substantially eliminated as shown in FIG. 7. Lever arms 420 support surface 410 and guide support surface 410 along a desired path of travel through interaction with the ramp profile of ramp 440 through ramp follower 435. Ramp follower 435 is preferably connected to lever arms 420 through an adjustment mechanism, such as adjustment screws 430. The adjustment mechanism allows fine tuning of the relative height of support surface 410 to pivoting tray 302.

Figure 14:
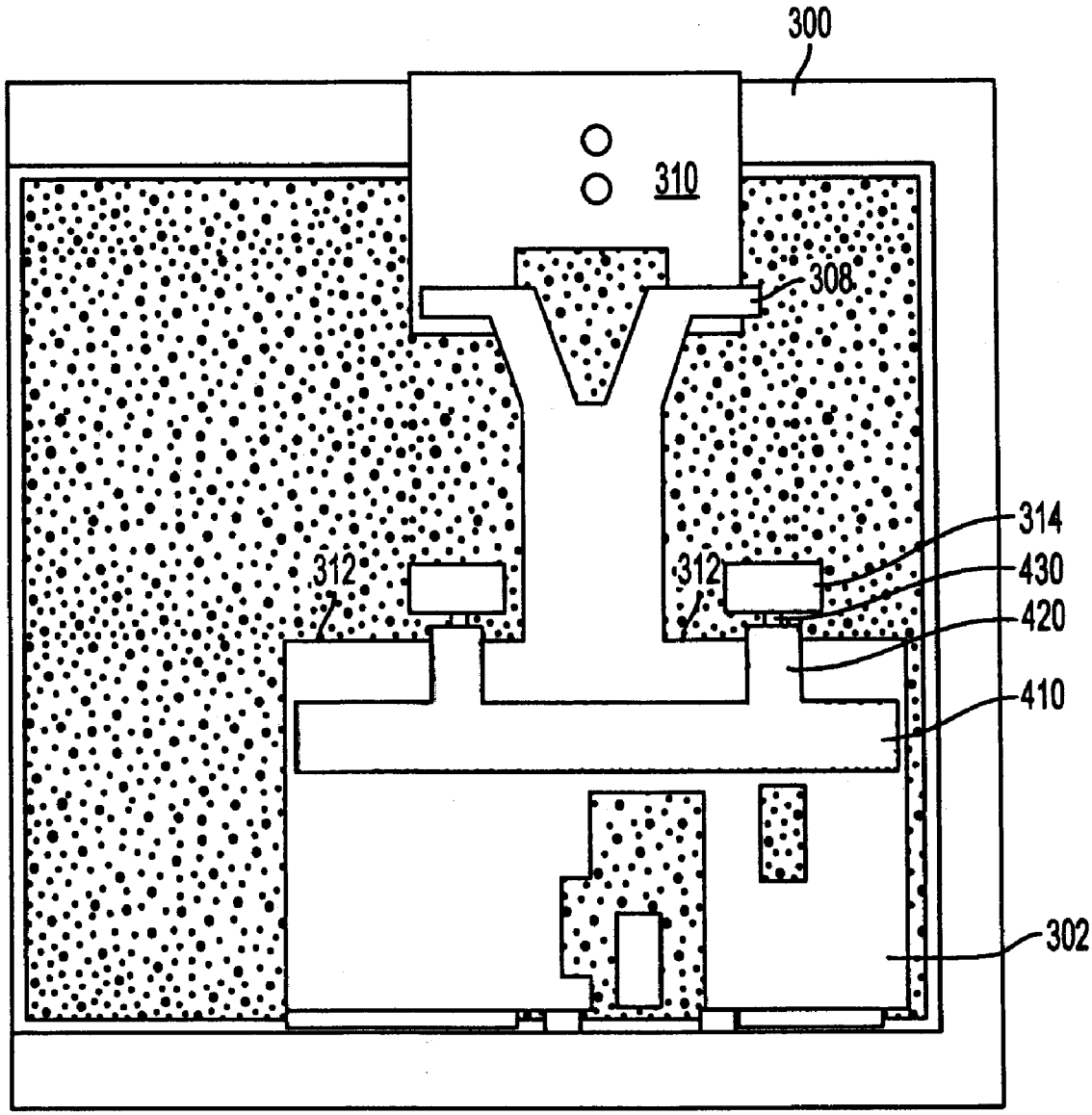
FIG. 14 shows a top view of the exemplary valley removal mechanism of FIGS. 10-13 mounted on a pivoting tray.

Valley removal mechanism 400 is positioned within feed tray 300 so that sheet media support surface 410 may extend above pivoting tray 302 intermediate ends of pivoting tray 302. This may be achieved, for example, by positioning sheet media support surface 410 above the pivoting tray 302 and extending lever arm(s) 420 through corresponding slots 312 in pivoting tray 302 (FIG. 14). With this positioning, support surface 410 is able to pivot freely relative to pivoting tray 302 providing a variable height relative to the pivoting tray 302. The orientation of the support surface 410 is independently controlled by a ramp and follower arrangement formed by ramp 440 and ramp follower 435. Preferably, ramp follower 435 is formed as part of adjustment screw 430. This enables fine tuning adjustment of the specific orientation of the support surface 410.

In its most simple form considering a purely pivotal tray 200, the ramp profile of ramp 440 can be substantially flat and may consist of the vertical tray guide surface 314. However, in the specific example illustrated, pivoting tray 302 has a movement profile that includes both pivotal and translatory movements. That is, when traveling from the full stack position in FIG. 7 to the empty stack position of FIG. 9, pivoting tray 302 moves counterclockwise while follower 308 translates across surface 310 as shown. Because of this complex tray movement, the profile of ramp 440 must compensate for the pivotal and translatory movements of tray 302. This provides support surface 410 with a desired angle to offset and compensate for the resultant valley formed by the non-uniform thickness stack of media at any given stack height.

In the example shown, ramp follower 435 initially is on a substantially vertical surface of paper guide 314 at the full tray position of FIG. 7. This forces support surface 410 to substantially protrude above pivoting tray 302 and raise the media stack in that area to offset the valley. However, when the size of the stack is reduced and the pivoting tray 302 is lifted upward, ramp follower 435 contacts ramp profile section 442, transitions around inflection point 444, and then follows ramp profile section 446, to slowly transition the support surface 410 first to an intermediate travel position as shown in FIG. 8 and then subsequently to an empty position as shown in FIG. 9 where support surface 410 is substantially parallel with pivoting tray 302. This specific ramp profile is merely exemplary for the particular movement patterns and media thickness encountered in the particular device shown. However, in all embodiments, the support surface 410 of valley removal mechanism 400 generally decreases in relative height as the media stack thickness is reduced.

In will become apparent that the specific profile of ramp 440 will be dependent on various control parameters, including the particular movement profile of the pivoting tray 302, the size, location and non-uniformity of media 118 on the tray, the desired media capacity in the tray, and other possible variables. A suitable profile may be determined empirically or through experimental trial and error testing.

Figure 1:
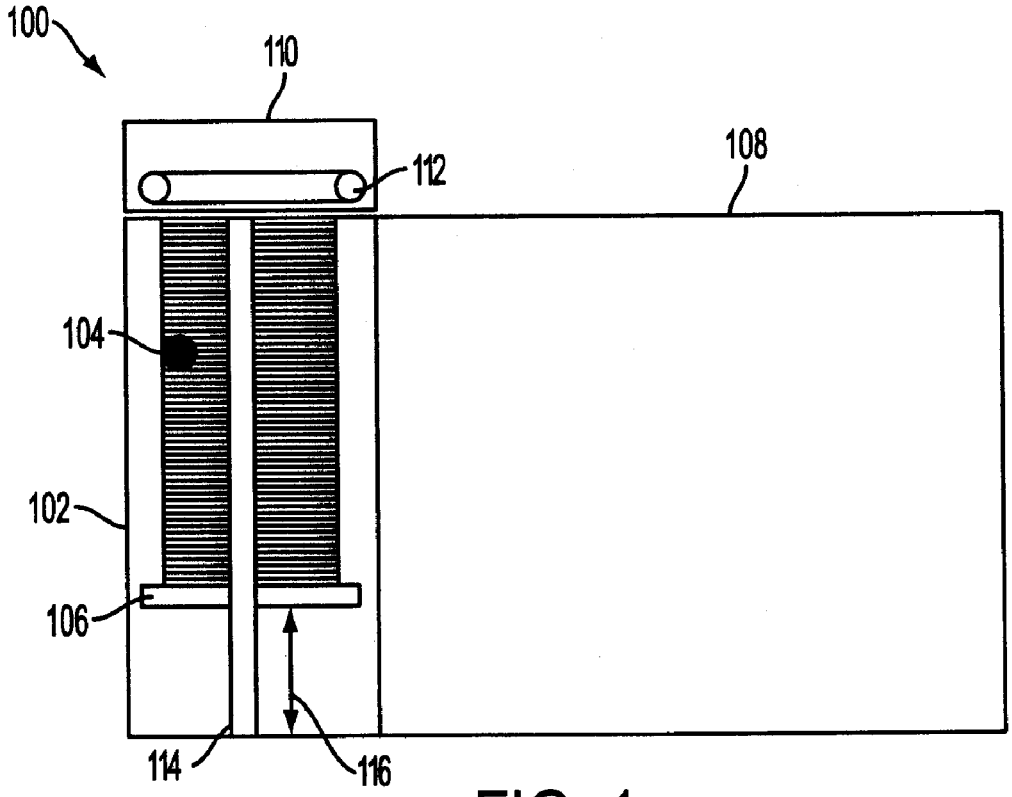
FIG. 1 PRIOR ART
FIG. 1 shows an example of a feed tray coupled to a processing machine.
Figure 2:
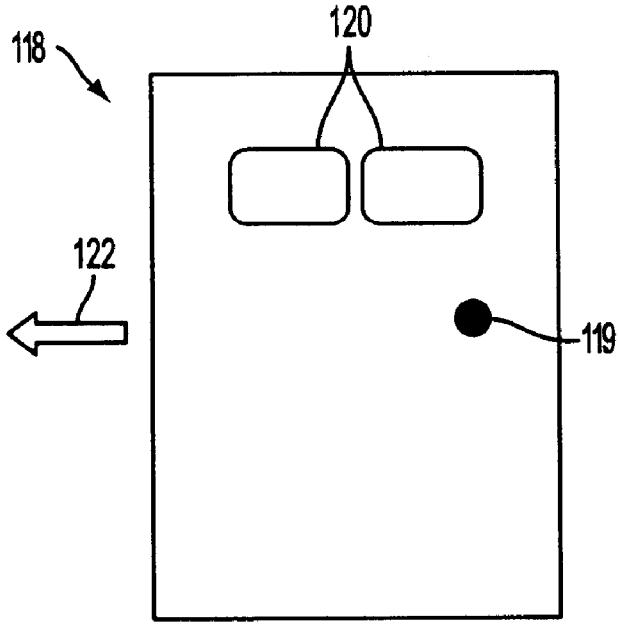
FIG. 2 shows an example of an object to be processed, such as a DocuCard.
Figure 3:
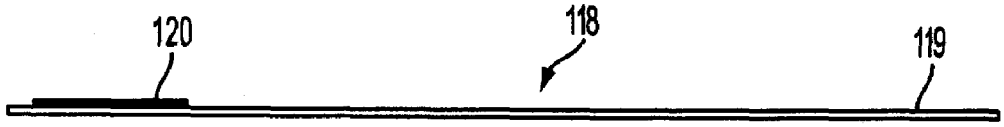
FIG. 3 shows a profile of conventional DocuCard or other sheet media with uneven sheet thickness.
Figure 4:
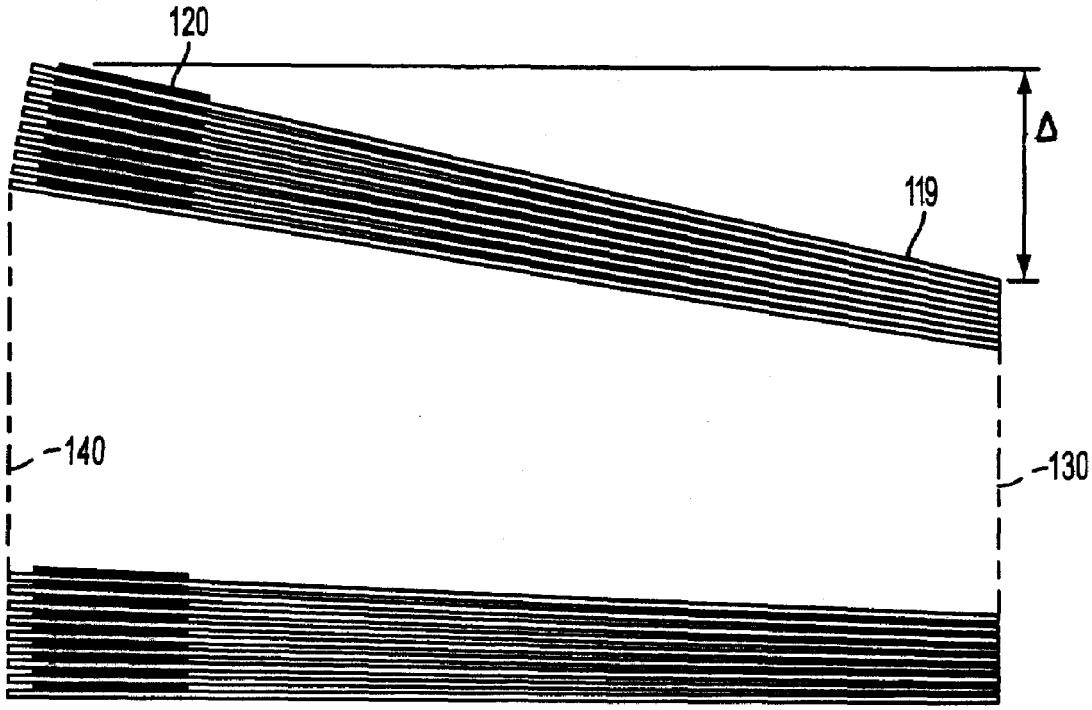
FIG. 4 shows a stack of DocuCards or other sheet media with uneven sheet thickness.
Figure 5:
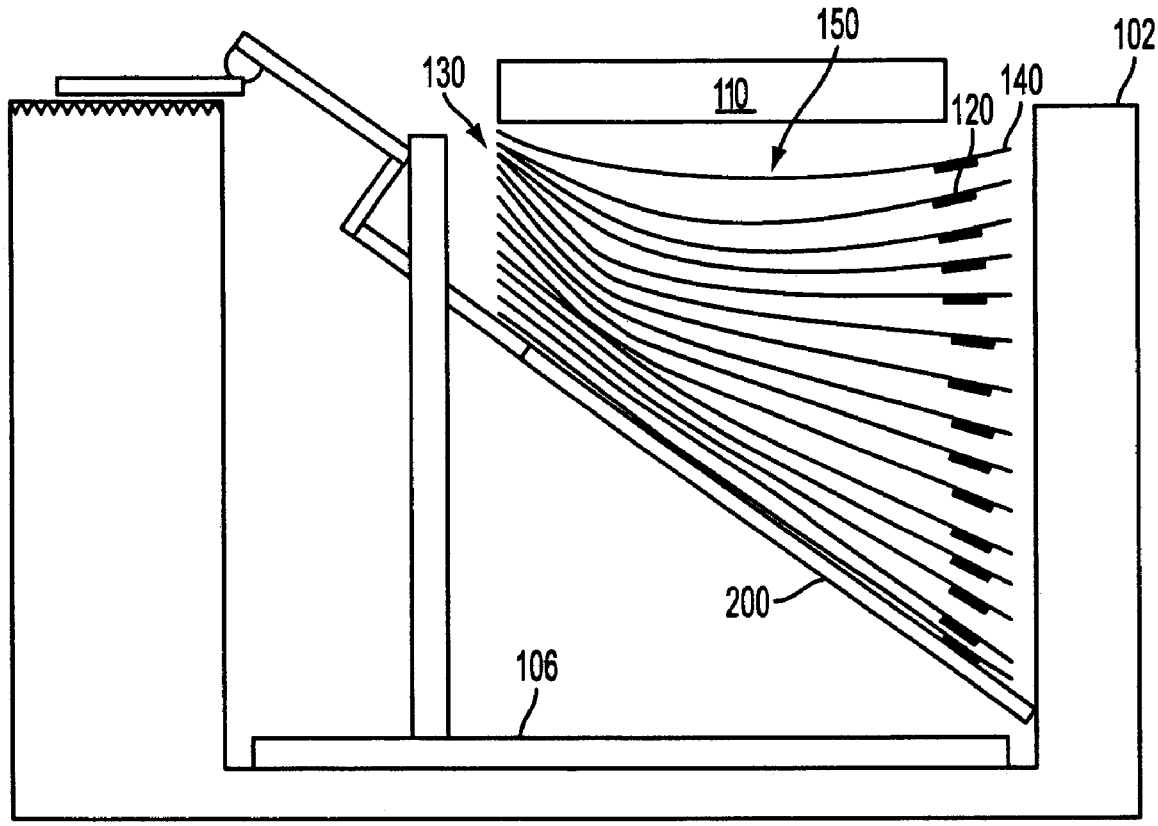
FIG. 5 PRIOR ART
FIG. 5 shows a side view of a feed tray assembly exhibiting the problem of having an excessive recording media valley.
Figure 6:
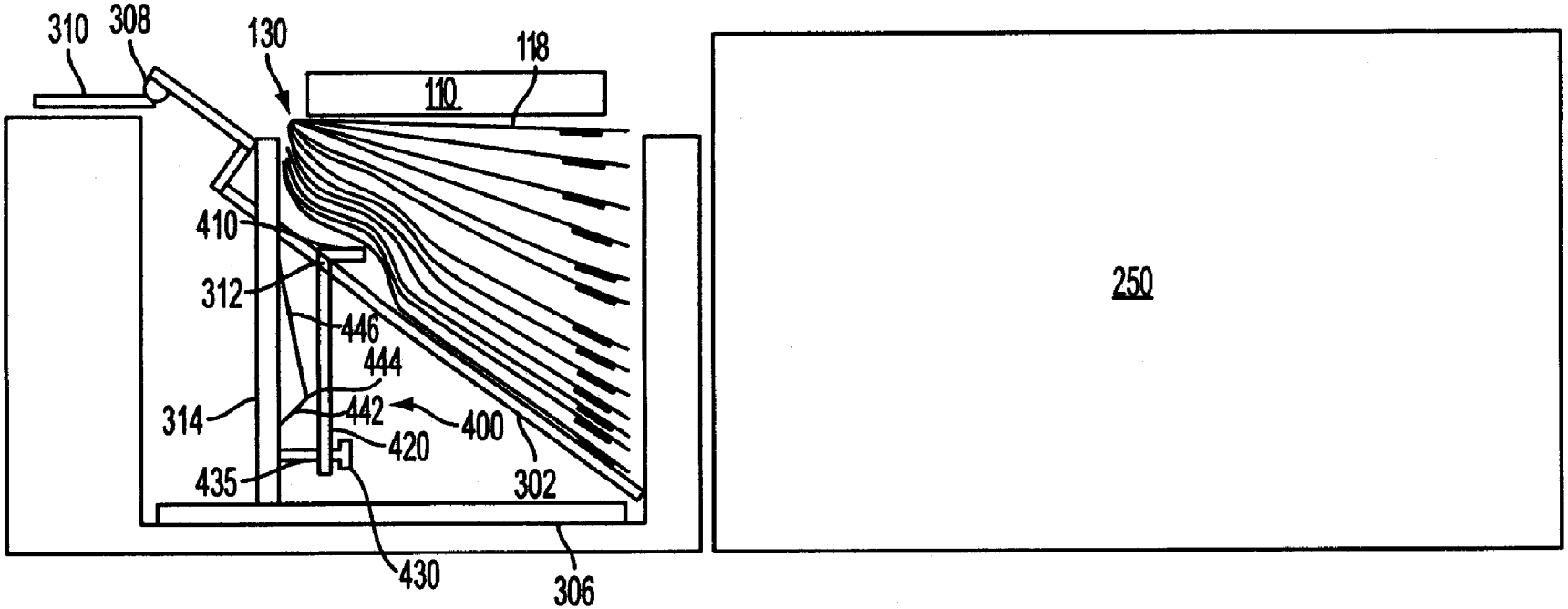
FIG. 6 shows an exemplary office equipment in the form of a copier incorporating a feed tray to which a valley removal mechanism is provided.

In a specific example, feed tray 300 is designed to handle at least 600 sheets of DocuCards or similar non-uniformed thickness media. At such capacities, this media would normally exhibit a very large valley 150 as shown in FIG. 5. However, due to the document valley removal mechanism 400, a section of the bottom of the stack of media intermediate ends 130, 140 is suitably supported by support surface 410 of the valley removal mechanism 400 to remove or at least substantially remove the valley.

Preferably, the support surface extends across a majority of the media width as shown in FIG. 14. This helps to uniformly remove the valley across the entire sheet and results in a profile for the uppermost sheet that is substantially flat and suitably oriented relative to feeder 110 to enable reliable sheet feeding. This profile may be substantially parallel to the sheet feeder.

Valley removal mechanism 400 may be separable from tray 302 or may be an integral part of feeder 300. Also, while an illustrated embodiment is directed to a feeder stack tray, similar advantages may be achieved by an output tray having a valley removal mechanism to similarly remove the valley from a stack of non-uniform thickness media and provide a substantially flat top media surface.

While the above examples relate to objects such as DocuCards, the stack tray and valley removal mechanism may be used to support other objects having non-uniform thickness across a surface thereof. For example, transparencies may have a tab on one edge that is of a different thickness than other portions of the transparency. Thus, when transparencies are stacked in a tray, one edge of the transparency stacks higher than the opposing edge causing possible feed difficulties.

While an exemplary embodiment orients the stack so that feeder 110 feeds the recording media in a direction parallel to the pivot axis of pivoting tray 302 (into the paper as illustrated), because the resultant top media sheet is supported so as to be substantially flat, feeder 110 can feed in other directions.

It would appreciated that various of the above-disclosed and other features and functions or alternatives thereof, may be desirably combined into many other different systems or applications. Also, that various presently unseen or unanticipated alternatives, modifications, variations or improvements therein may be subsequently made by those skilled in the art which are also intended to be encompassed by the following claims.

What is claimed is:

1. A leveling device for a stacking tray that compensates for end-to-end thickness variations in a stack of non-uniform thickness media and reduces a valley in the stack, comprising:

a pivoting stack tray that receives the stack of non-uniform thickness media thereon, one end of the tray configured to receive and contact a thicker end of the stack and being pivoted relative to an opposite end thereof between full tray and empty tray positions to provide level top ends of the stack; and a valley removal mechanism mounted to the pivoting stack tray, the valley removal mechanism including:

a media support surface positioned above the pivoting stack tray intermediate ends of the pivoting stack tray and below the stack, the media support surface supporting at least a portion of an intermediate section of the stack and being pivotally movable relative to the pivoting stack tray;

a ramp surface having a predefined profile; and at least one lever arm operably connected between the media support surface and at least one ramp follower to move the media support surface relative to the pivoting stack tray in accordance with the ramp surface profile and in proportion to the height of the stack to offset a valley formed intermediate ends of the stack and provide a top media in the stack with a substantially flat top surface profile, wherein the pivoting stack tray moves with a combination of pivoting and translatory movement between the full tray and empty tray positions and the ramp profile guides the media support surface to compensate for the combination movement of the pivoting stack tray.

2. The leveling device according to claim 1, wherein the media support surface includes a flat cross bar that extends across a substantial width of the pivoting stack tray.

3. The leveling device according to claim 2, wherein the pivoting stack tray includes at least one slot and the at least one lever arm extends through the slot, the cross bar extending laterally beyond the at least one slot so that movement of the cross bar is at least partially dependent on the relative position of the pivoting tray.

4. The leveling device according to claim 3, wherein two spaced lever arms are provided through the at least one slot.

5. The leveling device according to claim 2, wherein the ramp is formed on a vertical media guide member.

6. A leveling device for a stacking tray that compensates for end-to-end thickness variations in a stack of non-uniform thickness media and reduces a valley in the stack, comprising:

a pivoting stack tray that receives the stack of non-uniform thickness media thereon, one end of the tray configured to receive and contact a thicker end of the stack and being pivoted relative to an opposite end thereof between full tray and empty tray positions to provide level top ends of the stack;

a valley removal mechanism mounted to the pivoting stack tray, the valley removal mechanism including:

a media support surface positioned above the pivoting stack tray intermediate ends of the pivoting stack tray and below the stack, the media support surface supporting at least a portion of an intermediate section of the stack and being pivotally movable relative to the pivoting stack tray;

a ramp surface having a predefined profile; and at least one lever arm operably connected between the media support surface and at least one ramp follower to move the media support surface relative to the pivoting stack tray in accordance with the ramp surface profile and in proportion to the height of the stack to offset a valley formed intermediate ends of the stack and provide a top media in the stack with a substantially flat top surface profile; and at least one adjustment device that provides fine tuning adjustment of the static position of the media support surface relative to the pivoting tray.

7. The leveling device according to claim 6, wherein the adjustment device is an adjustment screw provided between the ramp follower and the lever arm.

8. The leveling device according to claim 1, wherein the pivoting stack tray has a capacity of over 200 sheets of media while maintaining the top media substantially flat.

9. The leveling device according to claim 8, wherein the pivoting stack tray has a capacity of between 200 and about 600 sheets of media while maintaining the top media substantially flat.

10. A feeder assembly for feeding a stack of non-uniform thickness media, comprising:

a pivoting stack tray that receives the stack of non-uniform thickness media thereon, one end of the tray configured to receive and contact a thicker end of the stack and being pivoted relative to an opposite end thereof between full tray and empty tray positions to provide level top ends of the stack;

a valley removal mechanism mounted to the pivoting stack tray, the valley removal mechanism including:

a media support surface positioned above the pivoting stack tray intermediate ends of the pivoting stack tray and below the stack, the media support surface supporting at least a portion of an intermediate section of the stack and being pivotally movable relative to the pivoting stack tray;

a ramp surface having a predefined profile; and at least one lever arm operably connected between the media support surface and at least one ramp follower to move the media support surface relative to the pivoting stack tray in accordance with the ramp surface profile and in proportion to the height of the stack to offset a valley formed intermediate ends of the stack and provide a top media in the stack with a substantially flat top surface profile; and a feeder positioned directly above the top media in the stack, the feeder having a media contact surface, wherein the combination of the pivoting stack tray and valley removal mechanism position a top media in the stack substantially parallel with the media contact surface of the feeder at all travel positions of the pivoting stack tray between the full tray and empty tray positions, the pivoting stack tray moves with a combination of pivoting and translatory movement between the full tray and empty tray positions, and the ramp profile guides the media support surface to compensate for the combination movement of the pivoting stack tray.

11. The feeder assembly according to claim 10, wherein the feeder is an endless belt feeder.

12. The feeder assembly according to claim 10, wherein the media support surface includes a flat cross bar that extends across a substantial width of the pivoting stack tray.

13. The feeder assembly according to claim 12, wherein the pivoting stack tray includes at least one slot and at least one lever arm extends through the slot, the cross bar extending laterally beyond at least one slot so that movement of the cross bar is at least partially dependent on the relative position of the pivoting stack tray.

14. The feeder assembly according to claim 13, wherein two spaced lever arms are provided through the at least one slot.

15. The feeder assembly according to claim 10, wherein the ramp is formed on a vertical media guide member.

16. A feeder assembly for feeding a stack of non-uniform thickness media, comprising:

a pivoting stack tray that receives the stack of non-uniform thickness media thereon, one end of the tray configured to receive and contact a thicker end of the stack and being pivoted relative to an opposite end thereof between full tray and empty tray positions to provide level top ends of the stack;

a valley removal mechanism mounted to the pivoting stack tray, the valley removal mechanism including:

a media support surface positioned above the pivoting stack tray intermediate ends of the pivoting stack tray and below the stack, the media support surface supporting at least a portion of an intermediate section of the stack and being pivotally movable relative to the pivoting stack tray;

a ramp surface having a predefined profile; and at least one lever arm operably connected between the media support surface and at least one ramp follower to move the media support surface relative to the pivoting stack tray in accordance with the ramp surface profile and in proportion to the height of the stack to offset a valley formed intermediate ends of the stack and provide a top media in the stack with a substantially flat top surface profile;

a feeder positioned directly above the top media in the stack, the feeder having a media contact surface; and at least one adjustment device that provides fine tuning adjustment of the static position of the media support surface, wherein the combination of the pivoting stack tray and valley removal mechanism position a top media in the stack substantially parallel with the media contact surface of the feeder at all travel positions of the pivoting stack tray between the full tray and empty tray positions.

17. The feeder assembly according to claim 16, wherein the adjustment device is an adjustment screw provided between the ramp follower and the lever arm.

18. A xerographic device comprising the feeder assembly of claim 10.

* * * * *